US009651333B1

(12) United States Patent
Princiotta

(10) Patent No.: US 9,651,333 B1
(45) Date of Patent: May 16, 2017

(54) ARCHERY AID

(71) Applicant: James Princiotta, Pittston, ME (US)

(72) Inventor: James Princiotta, Pittston, ME (US)

( * ) Notice: Subject to any disclaimer, the term of this patent is extended or adjusted under 35 U.S.C. 154(b) by 0 days.

(21) Appl. No.: 14/982,667

(22) Filed: Dec. 29, 2015

(51) Int. Cl.
*F16M 11/00* (2006.01)
*F41B 5/14* (2006.01)

(52) U.S. Cl.
CPC ..... *F41B 5/1453* (2013.01)

(58) Field of Classification Search
CPC ..... F41B 5/00; F41B 5/1426; F41B 5/1453
See application file for complete search history.

(56) References Cited

U.S. PATENT DOCUMENTS 1,028,787 A * 6/1912 Rossmeissl ..... A47G 33/12 248/525
5,240,211 A 8/1993 Anderson
6,029,643 A * 2/2000 Golfieri ..... F41B 5/14 124/1
6,205,992 B1 3/2001 Meeks et al.
6,425,765 B1 7/2002 Irwin, III
7,311,097 B1 12/2007 Callis
7,347,402 B2 * 3/2008 White ..... F16M 11/14 124/86
7,434,773 B1 10/2008 Minjares
8,833,350 B1 9/2014 Specht
2013/0055998 A1 * 3/2013 LoRocco ..... F41B 5/1426 124/89

OTHER PUBLICATIONS

"Archery—Paralympic Athletes, Photos & Events" reprinted from http://www.paralympic.org/archery on Nov. 19, 2015, 1 page.
"Limited Mobility Compound Bow Mount," Adaptiveoutdoorsman.com, reprinted from http://www.adaptiveoutdoorsman.com/cb100.html on Nov. 19, 2015, 2 pages.
"Caldwell DeadShot FieldPod", Lancaster Archery Supply, reprinted from http://www.lancasterarchery.com/caldwelll-deadshot-fieldpod.html on Nov. 19, 2015, 2 pages.
"Primos Trigger Stick Short Tri Pod Gen 2," Lancaster Archery Supply, reprinted from http://www.lancasterarchery.com/primos-trigger-stick-short-tri-pod-gen-2.html on Nov. 19, 2015, 2 pages.
"Model CB100—Compound Bow Mount," Be Adaptive Disabled Hunting and Fishing Equipment, reprinted from http://www.beadaptive.com/products.html on Nov. 19, 2015, 1 pagea.

* cited by examiner

*Primary Examiner* — Amy Sterling
(74) *Attorney, Agent, or Firm* — Fish & Richardson P.C.

(57) ABSTRACT

An archery aid for a compound bow includes a tri-pod base; a mounting frame including a connection element for coupling the bow to the archery aid; and an assembly connecting the mounting frame to the tri-pod base. A dampening system dampens for/aft forces on the archery aid. A method of stabilizing an arrow in flight includes mounting a compound bow to an archery aid, the archery aid including a tri-pod base; and shooting the arrow from the compound bow mounted to the archery aid. The archery aid dampens the shot by minimizing kicking.

13 Claims, 14 Drawing Sheets

ARCHERY AID

TECHNICAL FIELD

This invention relates to an archery aid.

BACKGROUND

Stands and mounts for supporting a compound bow while the user aims and shoots the arrow from the bow are known. Such stands or mounts can provide left and right and up and down movement for aiming the bow.

SUMMARY

An archery aid for a compound bow includes a tri-pod base; a mounting frame including a connection element for coupling the bow to the archery aid; and an assembly connecting the mounting frame to the tri-pod base.

According to one aspect, the archery aid includes three curved legs forming the tripod base.

Embodiments of this aspect may include one or more of the following features.

The archery aid includes a dampening spring. The dampening springs acts between the mounting frame and the assembly. The connection element includes a spindle housing defining a star-shaped bore and a spindle including a star-shaped section. The assembly includes an outer bearing element, and the mounting frame includes an inner bearing element received by the outer bearing element. The assembly includes a bearing cup that coacts with the outer and inner bearing elements to adjust the relative positions of the bearing elements.

According to another aspect, an archery aid for a compound bow includes a tri-pod base; a mounting frame including a connection element for coupling the bow to the archery aid; an assembly connecting the mounting frame to the tri-pod base; and a dampening system configured and arranged to dampens for/aft forces on the archery aid.

Embodiments of this aspect may include one or more of the following features.

The dampening system includes a spring. The spring acts between the mounting frame and the assembly. The dampening system includes curved legs of the tri-pod base. The connection element includes a spindle housing defining a star-shaped bore and a spindle including a star-shaped section.

According to another aspect, a method of stabilizing an arrow in flight includes mounting a compound bow to an archery aid, the archery aid including a tri-pod base; and shooting the arrow from the compound bow mounted to the archery aid. The archery aid dampens the shot by minimizing kicking.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
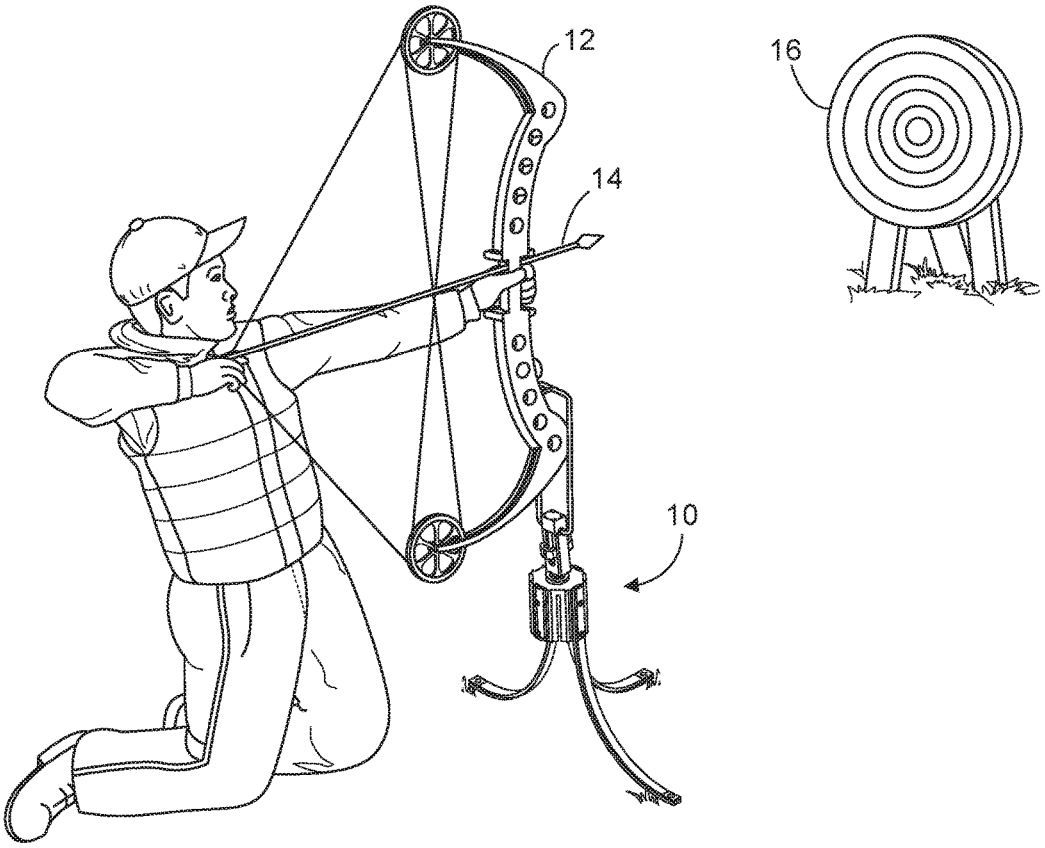
FIG. 1 is an illustration of an archery aid shown supporting a compound bow while the user aims the arrow.

Referring to FIG. 1, an archery aid 10 supports a compound bow 12 during aiming and shooting an arrow 14 at a target 16, for example a practice target or an animal when hunting. The archery aid 10 improves the arrow flight by stabilizing the bow through and after the shot, minimizing forward or back kicking of the bow. After the release and subsequent sudden stop of the bow string the top and bottom of the bow may move in a forward or back direction causing the kicking. The archery aid 10 also aids the user by supporting the weight of the bow 12.

Figure 2:
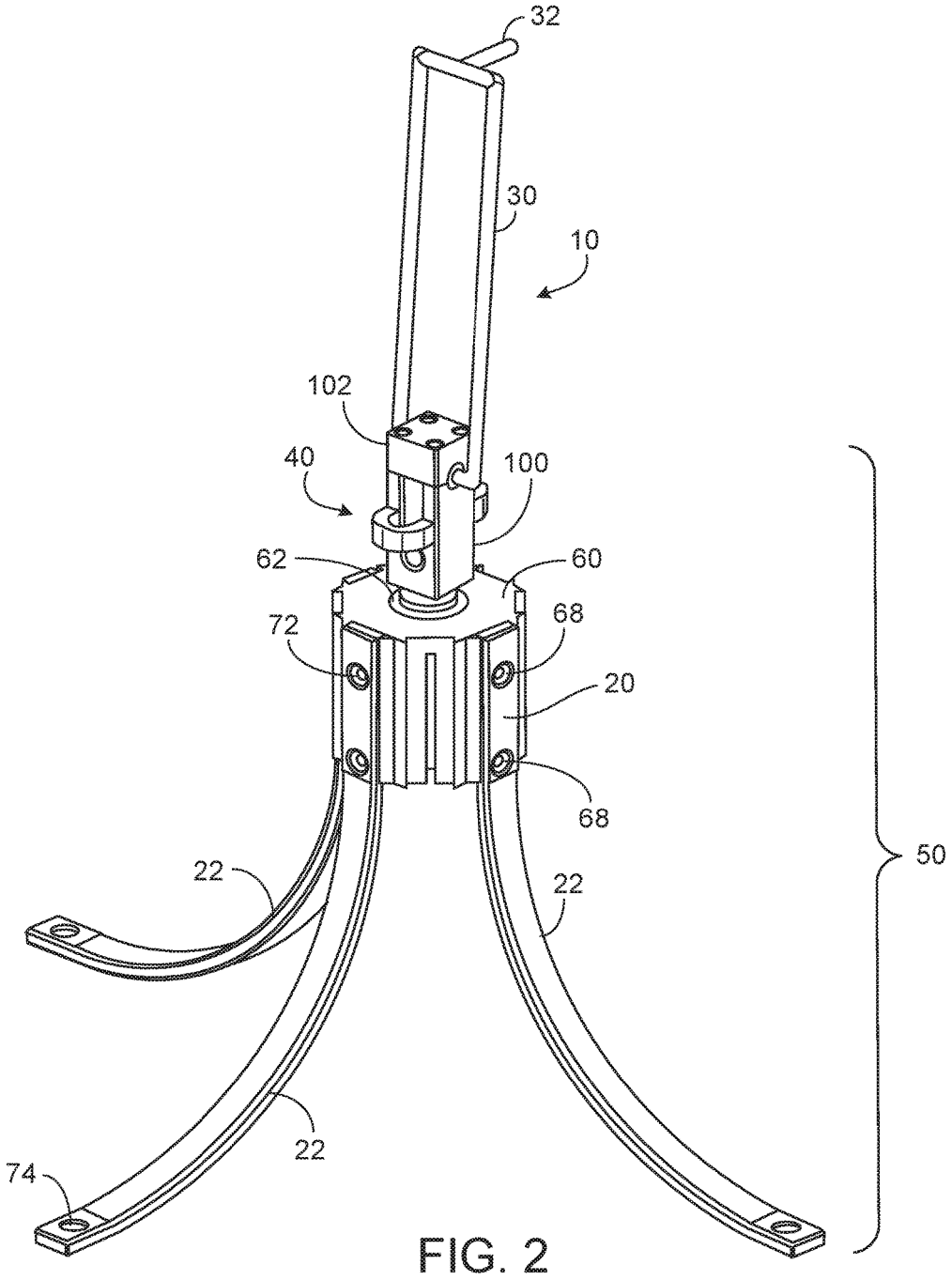
FIG. 2 is an illustration of the archery aid.

Referring to FIG. 2, the archery aid 10 includes three curved legs 22 forming a tri-pod base 20; a mounting frame 30 including a connection element 32, discussed further below, for coupling the bow 12 to the archery aid 10; and an assembly 40 connecting the mounting frame 30 to the tri-pod base 20. As illustrated in FIG. 1, the connection element 32, for example, a threaded rod, couples the bow 12 to the archery aid 10 in a plane 42. The archery aid 10 includes a dampening system 50, which is located below the plane 42.

Figure 3:
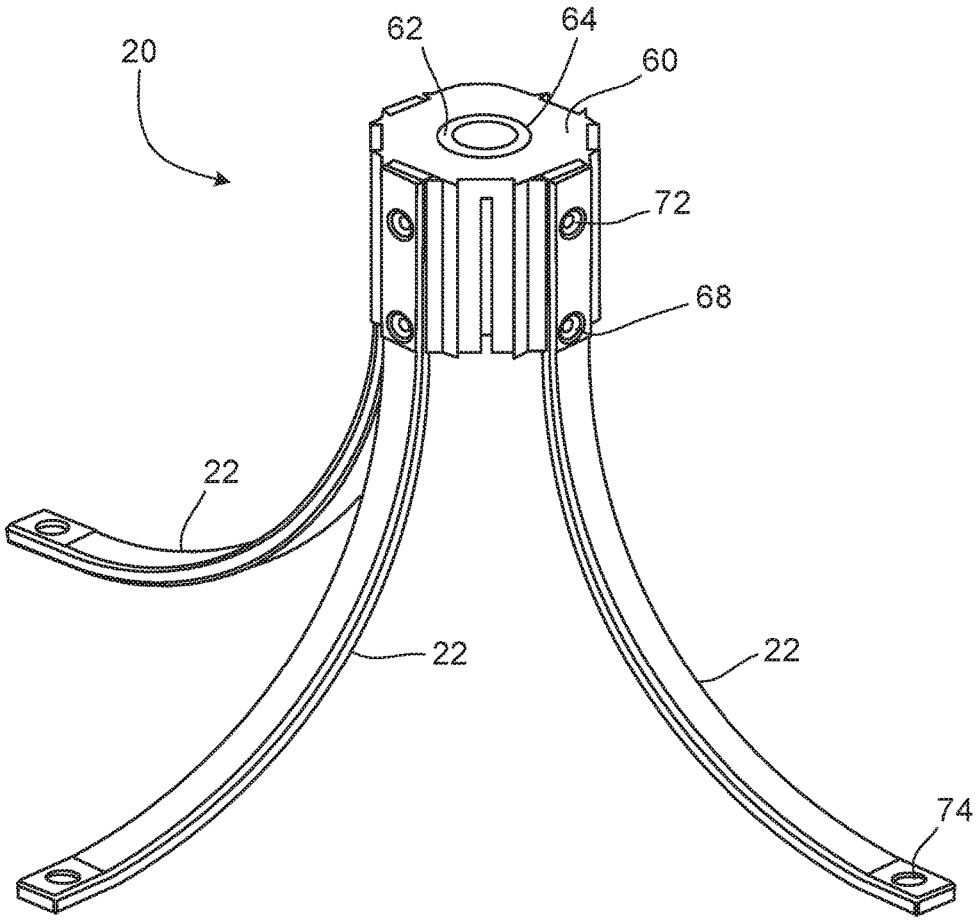
FIG. 3 is an isometric view of a tri-pod base of the archery aid.
Figure 4:
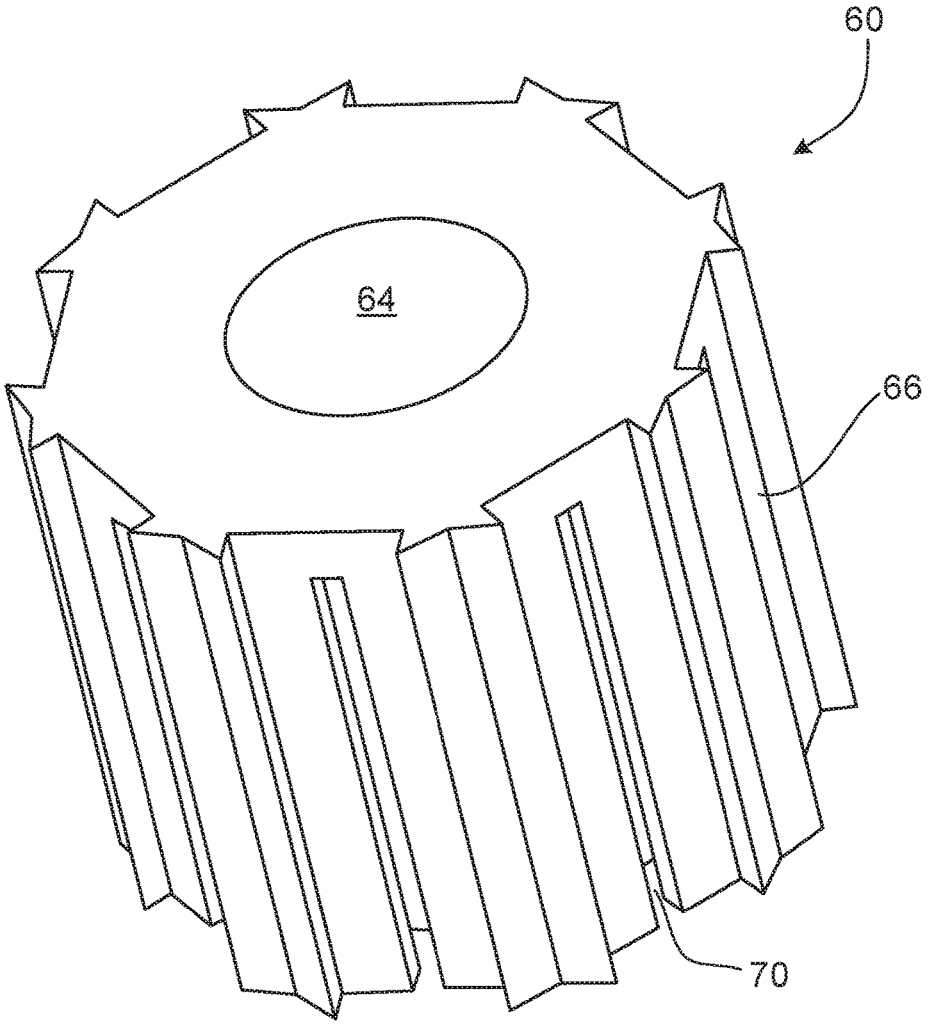
FIG. 4 illustrates a support block of the tri-pod base.
Figure 10:
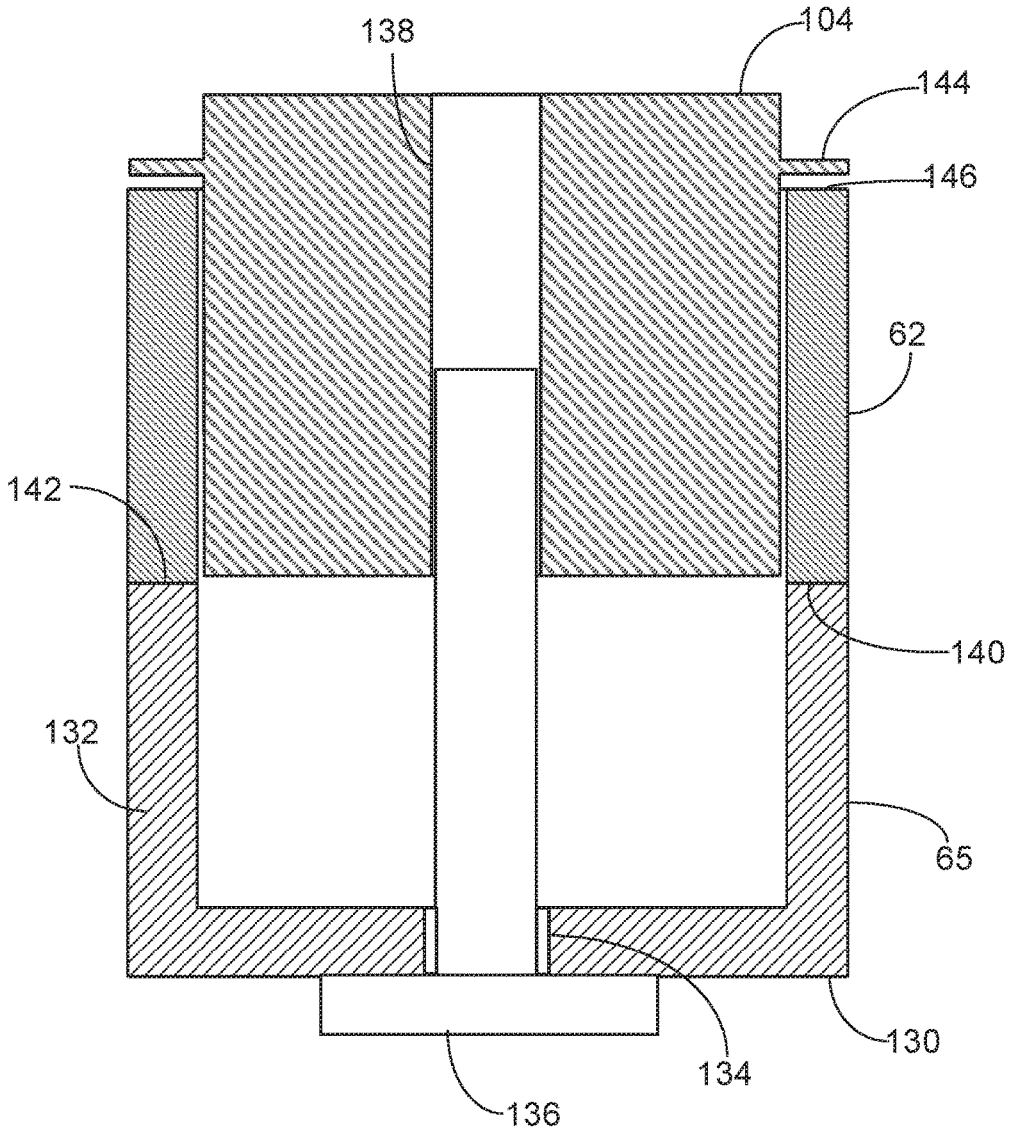
FIG. 10 is a cross-section view of the bearing and bearing cup.

Referring to FIGS. 3 and 4, the tri-pod base 20 includes a support block 60 to which legs 22 are mounted and in which an outer bearing element 62 is located. The support block 60 defines a bore 64 in which the outer bearing element 62 is received. The support block bore 64 also houses a bearing cup 65 (FIG. 5) located below and abutting the outer bearing element 62, as illustrated in FIG. 10, discussed below.

The support block 60 further defines outer channels 66, for example, eight outer channels as illustrated, each of which can slidably receive one of the legs 22. The height of the archery aid is set by adjusting the position of the legs 22 within the channels 66. Each leg defines two holes 68 and the support block 60 defines slots 70 for receiving mounting bolts 72 that fix the position of the legs 22 relative to the support block 60. The three channels 66 in which the legs 22 are mounted are selected to counterbalance the weight of the compound bow. In this way the stability of the archery aid 10 for individual bows can be optimized. Each leg 22 also defines a bottom stake hole 74 for receiving a stake 76 (FIG. 1) to hold the archery aid 10 relative to the ground.

Figure 6A:
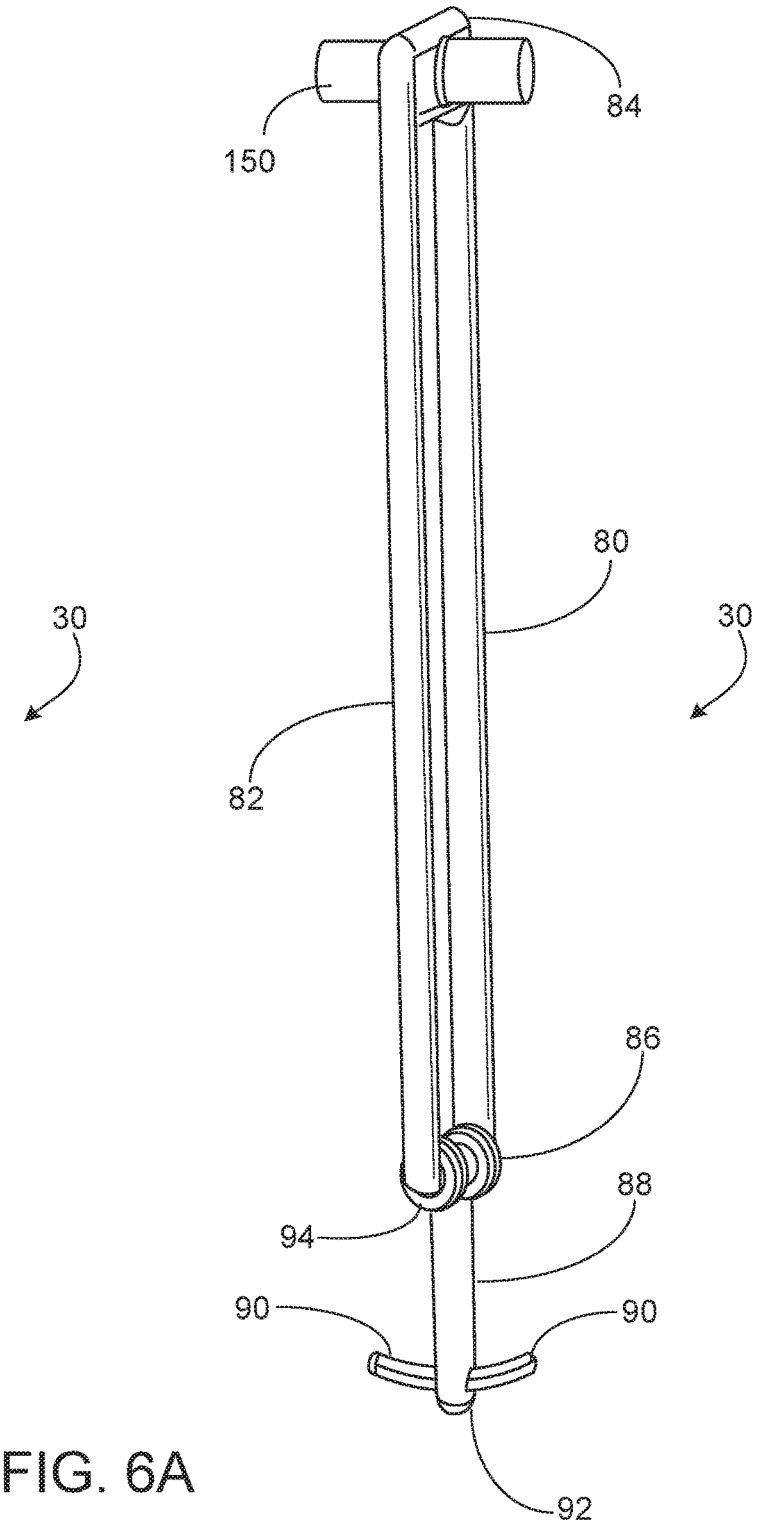
FIGS. 6A-6G are views of a mounting frame of the archery aid.
Figure 6B:
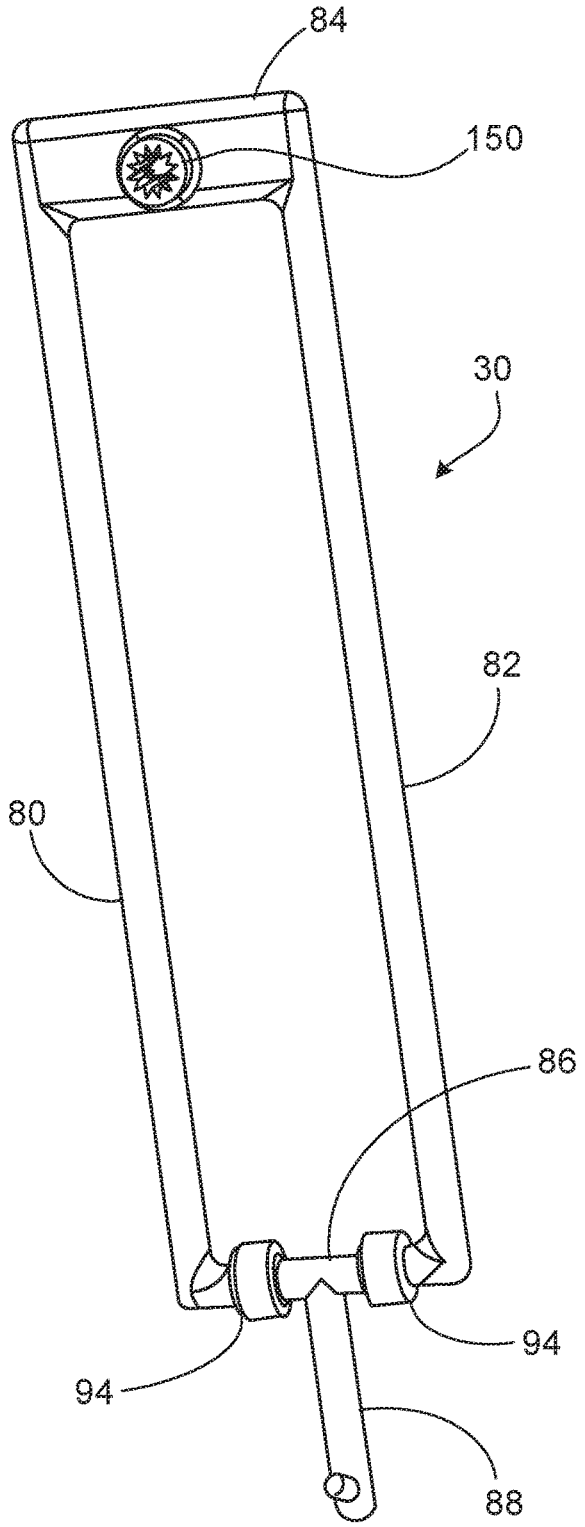
Figure 6C:
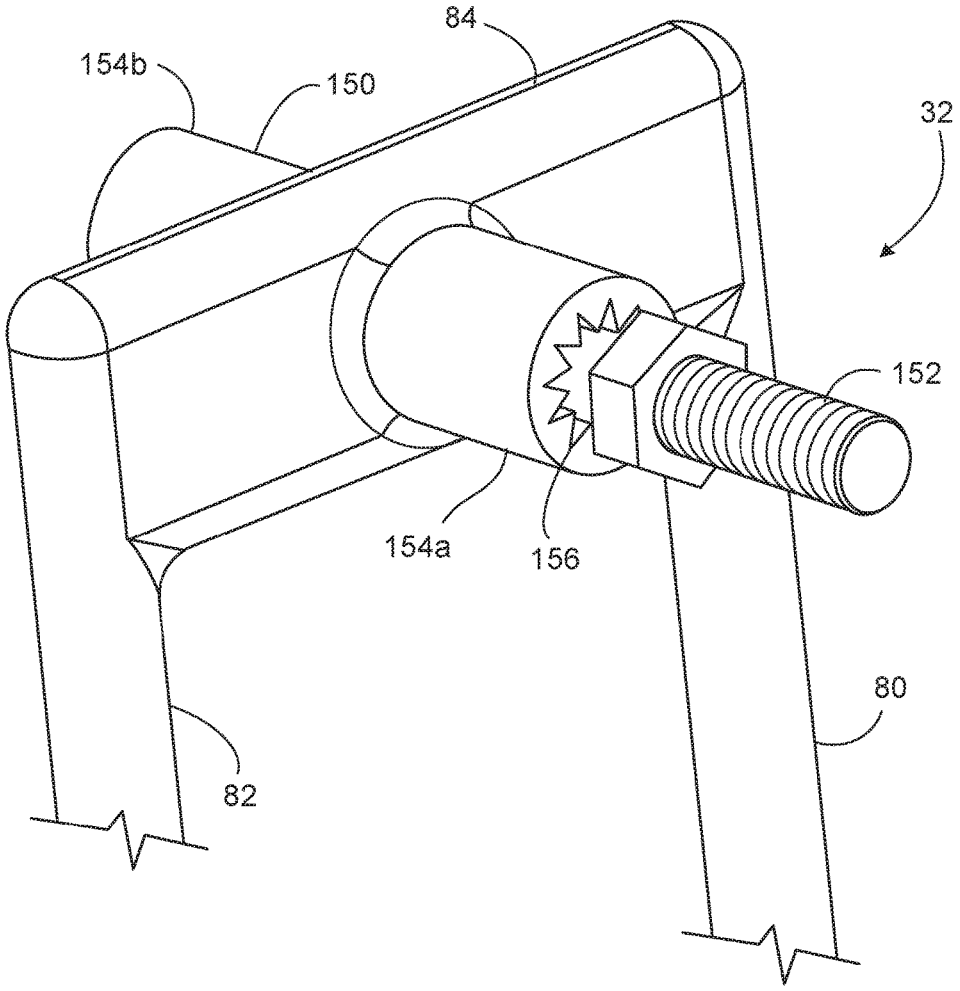

Referring to FIGS. 6A-6C, the mounting frame 30 includes two uprights 80, 82, an upper cross bar 84, and a lower cross bar 86. The bow connection element 32, here shown to include a spindle housing 150 and a spindle 152, extends from the upper cross bar 84. The mounting frame further includes a down tube 88 with two oppositely directed spurs 90 extending from the lower end 92 of the down tube 88. The spurs 90 and the connection element 32 lie in a common plane. Mounted to lower cross bar 86 are two bearings 94 that permit for/aft movement of the mounting frame 30 relative to the tri-pod base 20.

Figure 6D:
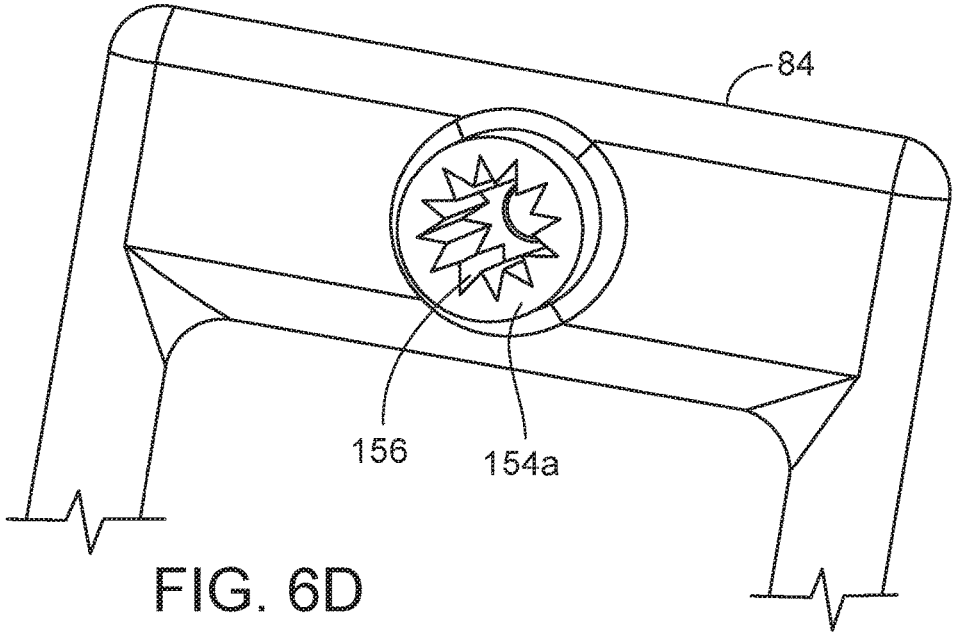
Figure 6E:
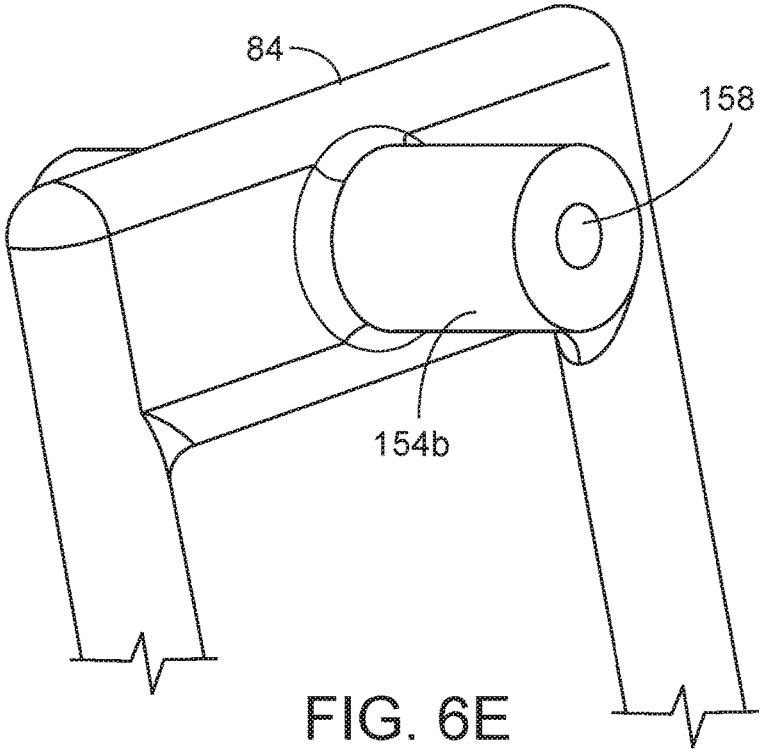

Referring to FIGS. 6C-6E, the spindle housing 150 has a first section 154*a* extending from one side of the cross bar 84, and second section 154*b* extending from the opposite side of the cross bar 84. The first section 154*a* defines a star-shaped, spindle receiving bore 156, and the second section 154*b* defines a threaded bore 158 for receiving a bow stabilizer, not shown.

Figure 6F:
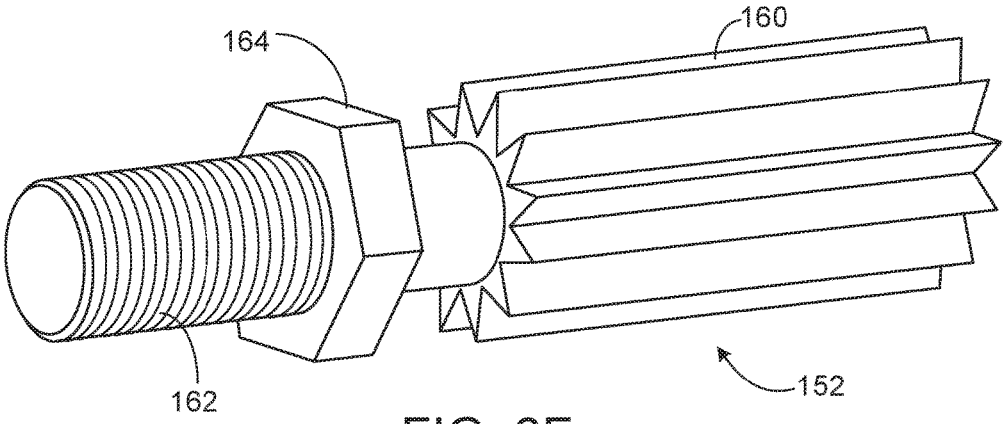
Figure 6G:
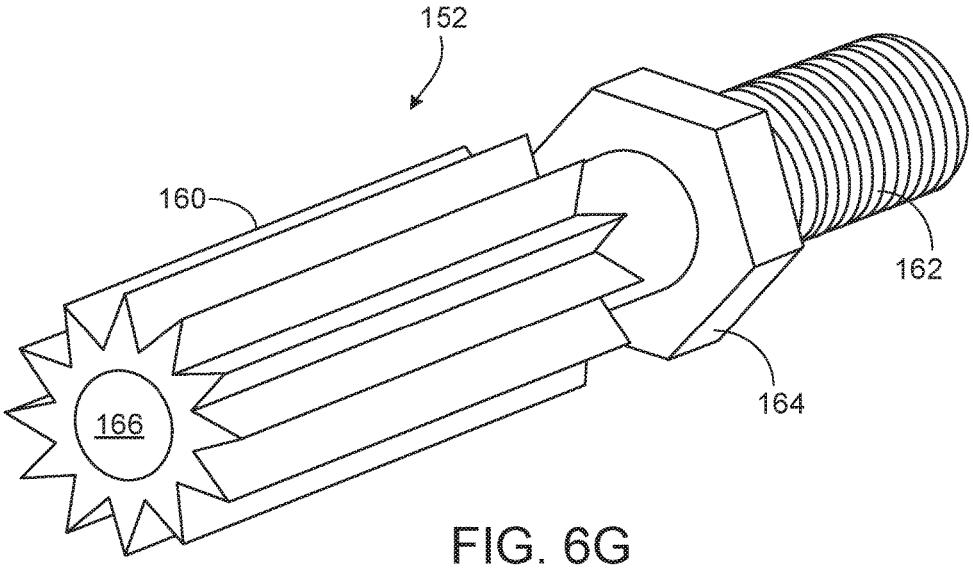

Referring to FIGS. 6F and 6G, the spindle 152 includes a star-shaped section 160 that is received in the spindle receiving bore 156 of the spindle housing 150, a threaded rod 162 that connects to the bow 12, and a nut 164 that limits the threading of the rod 162 into the bow 12. The section 160 defines a threaded bore 166 for receiving a bow stabilizer, not shown. The points of the starts of the spindle receiving bore 156 and section 160 are spaced, for example, at ⅛" intervals. This spacing and the ability to adjust the threading of the rod 162 into the bow 12 permits the user to align the bow 12 to the archery aid 10.

The threaded bore 158 permits the use of a bow stabilizer with the archery aid 10, and the threaded bore 166 permits the use of a bow stabilizer if just the spindle 152 is attached to the bow 12. When the spindle 152 is received in the spindle housing 150, the threaded bore 166 can receive a bolt, not shown, that secures the spindle 152 to the spindle housing 150.

Figure 7:
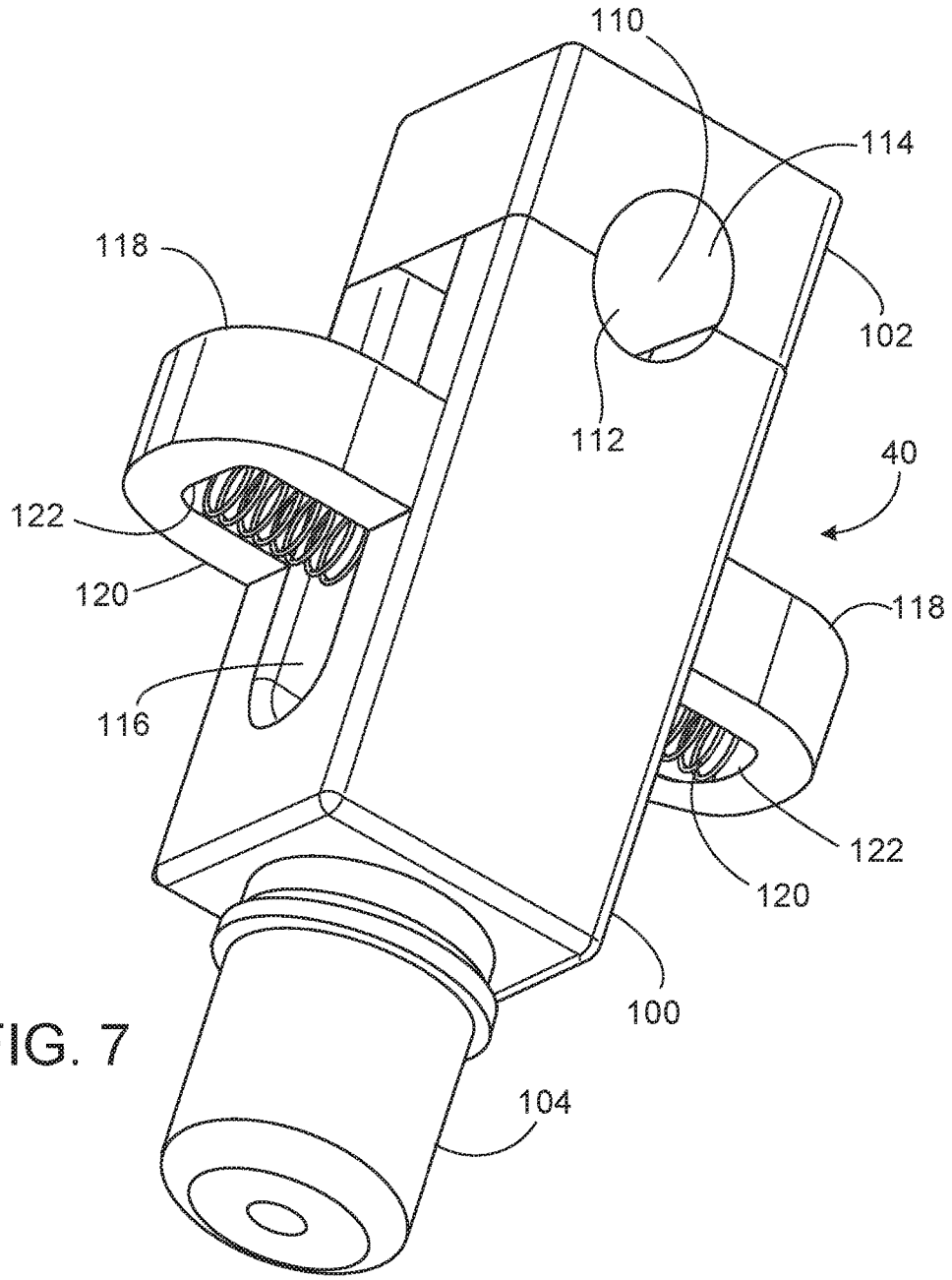
FIGS. 7-9 are views of a connector assembly that connects the mounting frame to the tri-pod base.
Figure 8:
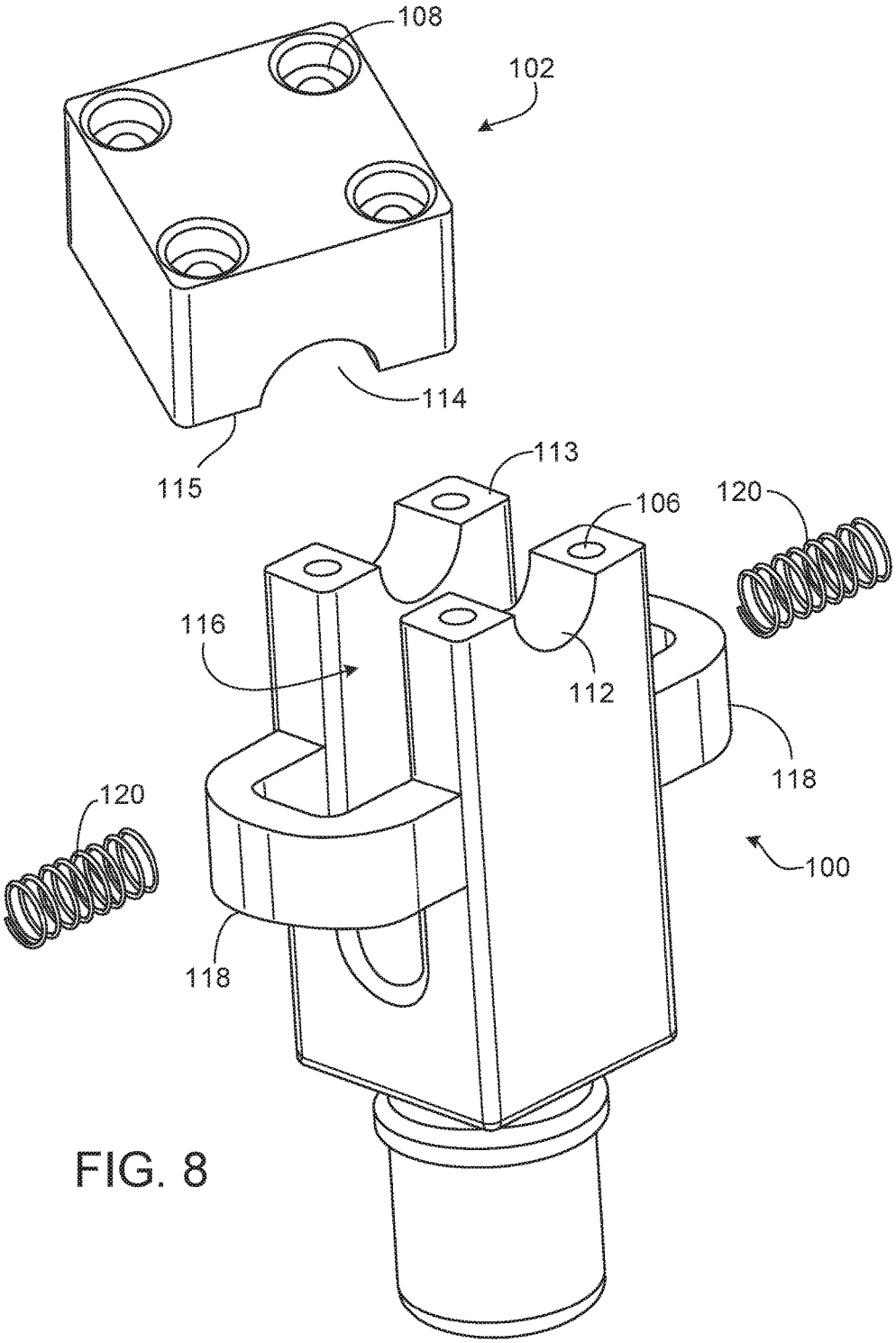
Figure 9:
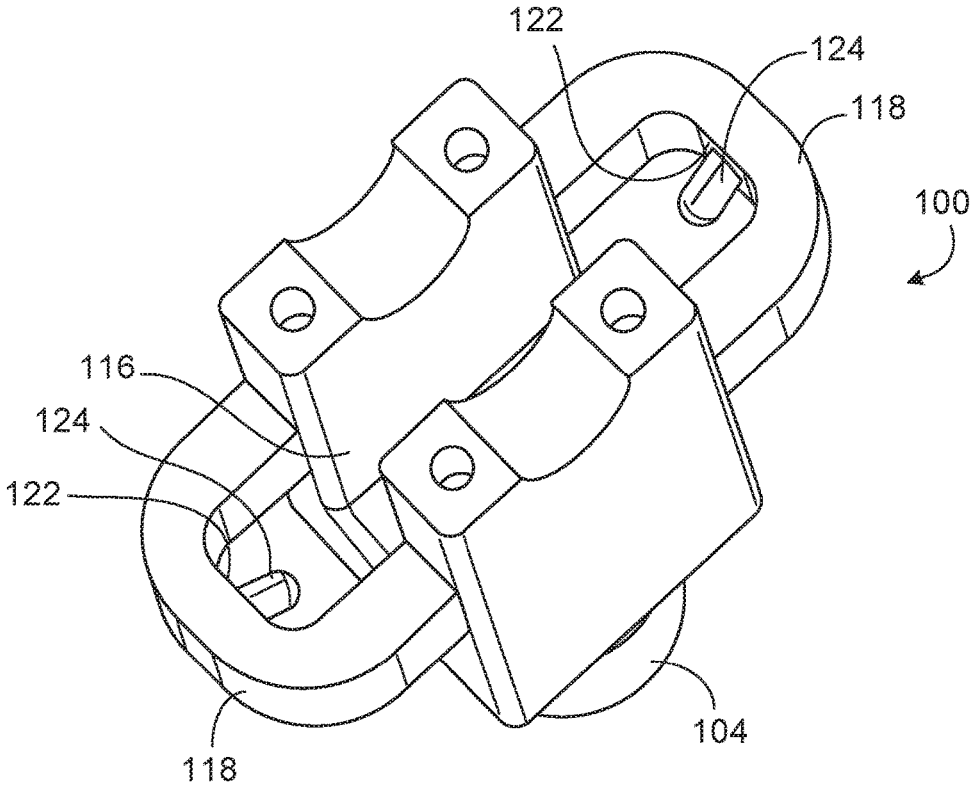

Referring to FIGS. 7-9, the assembly 40 that connects the mounting frame 30 to the tripod base 20 includes a bearing block 100 and a mounting block 102. The bearing block 100 has at one end an inner bearing element 104 that is received by outer bearing element 62 of the tri-pod base 20. Relative rotation between the bearing elements 62, 104 permits left/right aiming of the archery aid 10.

The bearing block 100 and the mounting block 102 each define bores 106, 108, respectively, for receiving bolts for attaching the mounting block 102 to the bearing block 100. When attached, the bearing block 100 and the mounting block 102 define a through hole 110 that receives the lower cross bar 86 of the mounting frame 30. The through hole 110 is formed by half-circle slots 112 in the upper surface 113 of the bearing block 100 and a half-circle channel 114 in the lower surface 115 of the mounting block 102. The bearings 94 of the mounting frame 30 are located within the half-circle slots 112.

The down tube 88 of the mounting frame 30 is received within a slot 116 in the bearing block 100 with spurs 90 extending out of the slots 112 within respective tabs 118 of the bearing block 100. Mounted around each of the spurs 90 is a spring 120 that acts between an inner surface 122 of the respective tab 114 and the down tube 88. Extending from the inner surfaces 122 of the tabs 114 are spurs 124 on which the springs 120 are received.

Figure 5:
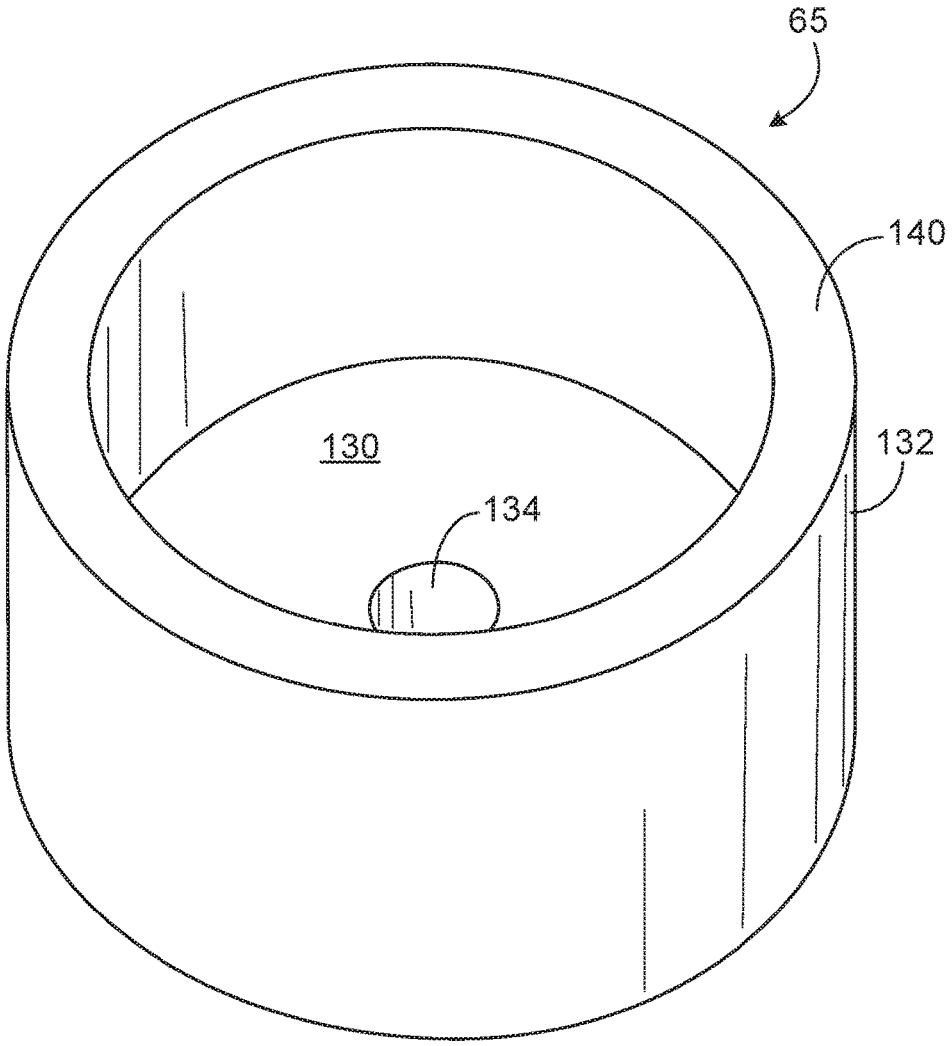
FIG. 5 illustrates a bearing cup of the tri-pod base.

The connection of the bearing cup 65 to the inner and outer bearing elements 104, 62 is illustrated in FIG. 10. Referring also to FIG. 5, the bearing cup 65 has a base 130 and a circumferential wall 132. The base 130 defines a through hole 134 for receiving a bolt 136. The inner bearing element 104 defines a threaded bore 138 that receives the threaded end of the bolt 136. The bearing cup 65 has an upper surface 140 that contacts a lower surface 142 of the outer bearing element 62, and the inner bearing element 104 has a lip 144 that contacts an upper surface 146 of the outer bearing element 62. Rotation of the bolt 136 adjusts the position of the inner bearing element 104 relative to the outer bearing element 62 causing lip 144 to contact surface 146. The amount of force applied between the lip 144 and the surface 146 by adjustment of the bolt 136 determines the amount of force the archer must apply to rotate the frame 30 left/right relative to the tri-pod base 20.

The curved legs 22 and the springs 120 impart a desired amount of flexibility to the archery aid 10 to dampen the for/aft forces and any up/down forces acting on the archery aid 10 when an arrow 14 is released from the attached compound bow 12. The dampening acts to absorb kicking from the release of the arrow 14, which stabilizes the arrow 14 improving the arrow flight.

A method of stabilizing an arrow 14 in flight includes mounting the compound bow 12 to the archery aid 10, and shooting the arrow 14. The archery aid 10 dampens the shot by minimizing kicking.

The archer aid 10 preferably has a weight under five pounds for ease of transport while hunting, an adjustable height in the range of two to three feet, and a footprint of about two feet. Legs 22 can be formed from, for example, wood, plastic or metal. The tripod base 20, the assembly 40 and the uprights 80, 82 extend generally vertically relative to the ground, and the connection element 32 extends, for example, laterally at 90 degrees from the uprights 80, 82, generally horizontally relative to the ground.

A number of embodiments of the invention have been described. Nevertheless, it will be understood that various modifications may be made without departing from the spirit and scope of the invention. For example, the part of the rod 162 located between the star-shaped section 160 and the nut 164 could be formed of a material that provides flexibility. In addition to the bearings 94 permitting for/aft movement of the mounting frame 30 relative to the tri-pod base 20, additional bearings could be located along the upper cross bar 84 permitting for/aft movement of the spindle housing 150 relative to the mounting frame 30. Accordingly, other embodiments are within the scope of the following claims.

What is claimed is:

1. An archery aid for a compound bow, comprising:

three legs forming a tri-pod base, each of the legs being curved along a longitudinal length;

a mounting frame including a connection element for coupling the bow to the archery aid; and an assembly connecting the mounting frame to the tri-pod base, wherein the mounting frame comprises:

two uprights joined by an upper cross bar and a lower cross bar, the connection element extending from the upper cross bar, a mounting block and a bearing block that connect to define a through hole for receiving the lower cross bar, and an inner bearing element extending from the bearing block;

the assembly comprises:

a support block including an outer bearing element configured to receive the inner bearing of the mounting frame, and a bearing cup that coacts with the outer bearing element and the inner bearing element of the mounting frame to adjust the relative position of the outer bearing element and the inner bearing element of the mounting frame; and the legs connect to the support block of the assembly to form the tri-pod base.

2. The archery aid of claim 1 further comprising a dampening spring.

3. The archery aid of claim 2 wherein the dampening spring acts between the mounting frame and the assembly.

4. The archery aid of claim 1 wherein the connection element comprises a spindle housing defining a star-shaped bore and a spindle including a star-shaped section.

5. The archery aid of claim 1 wherein the support block defines channels, each channel being configured for receiving a leg of the three legs.

6. The archery aid of claim 1 wherein each leg defines a hole and the support block defines slots for receiving mounting bolts that fix the position of the legs relative to the support block.

7. The archery aid of claim 1 wherein the mounting frame includes a down tube with two oppositely directed spurs extending from a lower end of the down tube.

8. The archery aid of claim 7 wherein the spurs and the connection element lie in a common plane.

9. The archery aid of claim 1 further comprising two bearings mounted to lower cross bar that permit for/aft movement of the mounting frame relative to the tri-pod base.

10. The archery aid of claim 4 wherein the spindle housing defines a threaded bore.

11. The archery aid of claim 4 wherein the spindle includes a threaded rod for connecting to the bow.

12. The archery aid of claim 11 wherein the spindle includes a nut for limiting the threading of the rod into the bow.

13. The archery aid of claim 4 wherein the star shaped section defines a threaded bore.

* * * * *